United States Patent [19]

Vignaud et al.

[11] 4,327,260

[45] Apr. 27, 1982

[54] LOCKING DEVICE FOR TWO PUSH BUTTONS

[75] Inventors: Jean-Claude Vignaud, Angouleme; Gérard Juéry, Ruelle, both of France

[73] Assignee: La Telemecanique Electrique, France

[21] Appl. No.: 140,920

[22] Filed: Apr. 16, 1980

[30] Foreign Application Priority Data

Apr. 17, 1979 [FR] France ..... 79 10281

[51] Int. Cl.[3] ..... H01H 9/20; H01H 33/52

[52] U.S. Cl. ..... 200/50 C; 200/5 E; 200/322; 200/325

[58] Field of Search ..... 200/5 R, 5 B, 5 C, 5 D, 200/5 E, 18, 50 C, 61.78, 61.79, 61.8, 322, 323, 324, 325, 328, 330, 339, 340

[56] References Cited

U.S. PATENT DOCUMENTS

| | | | |
|---|---|---|---|
| 2,363,854 | 11/1944 | Bierenfeld | 200/50 C X |
| 2,786,911 | 3/1957 | Morgan | 200/61.79 |
| 3,369,100 | 2/1968 | Kussy et al. | 200/50 C X |
| 3,511,951 | 5/1970 | Miller | 200/50 C X |
| 3,674,948 | 7/1972 | Betlejewski et al. | 200/50 C |

*Primary Examiner*—Joseph V. Truhe
*Assistant Examiner*—Forester W. Isen
*Attorney, Agent, or Firm*—William A. Drucker

[57] ABSTRACT

A reciprocal locking device for the movements of two push buttons includes a pivoting bolt having the shape of a "T" which oscillates in a plane perpendicular to the directions of displacement of the push buttons and is urged back into a central rest position by its own resilient means.

4 Claims, 4 Drawing Figures

LOCKING DEVICE FOR TWO PUSH BUTTONS

BACKGROUND OF THE INVENTION

The invention relates to a locking device permitting the movement, at any one time, of only one of two push buttons each associated with an electrical switch and having substantially parallel directions of actuation. The device is of the kind in which, between two operating members each associated with one of the buttons, there is disposed the axis of a pivotable bolt having two ends one of which is displaced by the movement of a first member in such a manner that the other becomes placed in the path of the second element.

Such devices are advantageously used in pendant boxes utilised for the control of lifting apparatus.

THE PRIOR ART

In the devices known in the prior art, the volume occupied by the bolt is so large that the arrangement cannot be used in apparatus having dimensions as small as those which must be taken in the hand by the operator; furthermore, in a known manner of construction of such a locking device, if a force is exerted and maintained on one of the members to bring it into the working position, the other member becomes locked in its rest position, with the result that, if a reversal of the movements of the controlled apparatus is then to take place, it cannot be obtained at the opportune moment.

There has already been proposed in the French Patent Application No. 79.09416 filed Apr. 13, 1979, a device adapted to remedy a part of the inconveniences mentioned above; nevertheless this arrangement does not permit accordance with the requirements of reduced volume and simplicity of construction to which the present invention proposes to find a solution.

SUMMARY OF THE INVENTION

According to the invention, this result is obtained by reason of the fact that the bolt has the shape of a "T", of which the vertical arm constitutes a resilient member for return thereof into a central rest position symmetrical with respect to the two elements, that the axis of rotation of the pivot is parallel to the directions of displacement of the operating members, that each horizontal arm of the bolt carries a surface, inclined with respect to the axis of rotation, which becomes placed opposite to a respective operating member, when these members are at rest, that these inclined surfaces each terminate in an edge, and that, when the bolt takes up a working position by cooperation of a first inclined surface with a corresponding first operating member, the edge of the second inclined surface does not apply any force on the second operating member.

BRIEF DESCRIPTION OF THE DRAWINGS

Other features of the invention will be apparent from the following description of a preferred embodiment, with reference to the accompanying drawings, wherein:-

DESCRIPTION OF THE PREFERRED EMBODIMENT

Figure 1:
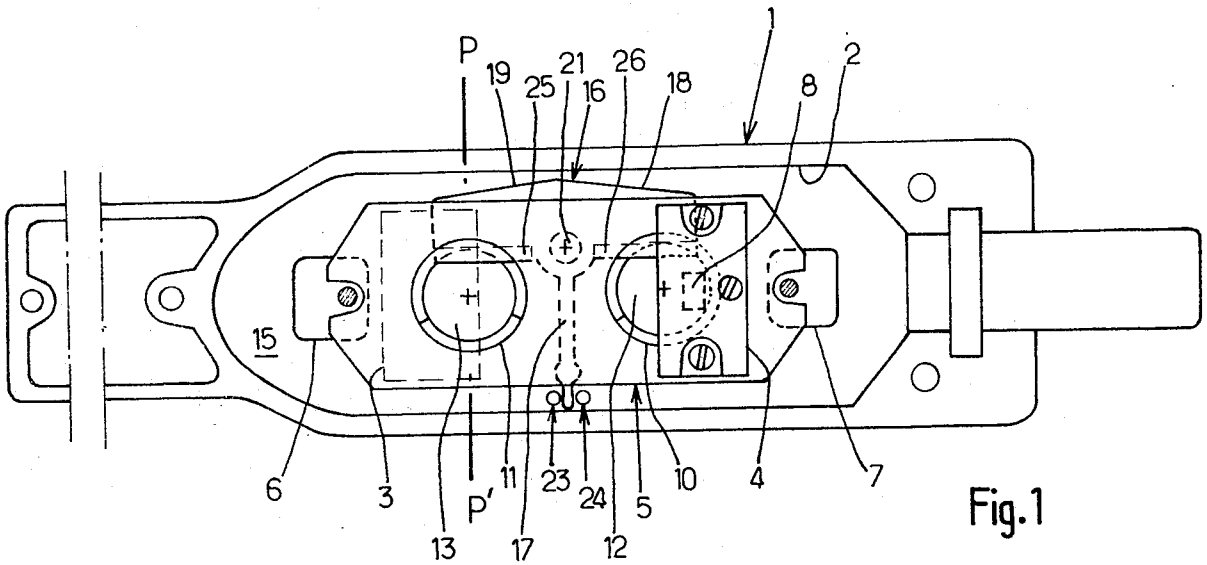
FIG. 1 is a view in elevation of a locking device for the control of two switches in a housing.

A housing 1 of a pendant switch box, seen in FIG. 1, has a recess 2 in which are disposed two switches 3 and 4 to be controlled, the switch 3 being shown in broken line for clarity of the figure.

Figure 3:
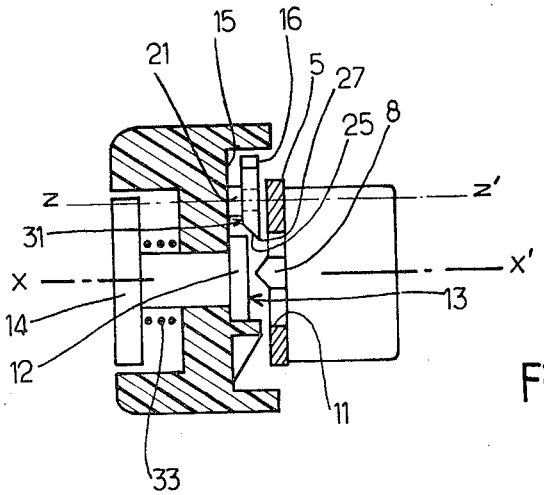
FIG. 3 is a view in section taken on the plane PP' of FIG. 1.

These two switches, one of which is also visible in FIG. 3, are fixed on a plate 5 which is mounted on two lugs 6, 7 in the recess. Each switch comprises a control finger 8 (see FIG. 3) which passes through a respective opening 10, 11 of the plate 5 and which is disposed adjacent to a respective cylindrical operating member 12, 13 on one extremity of a pushbutton being able to move along the axis YY'.

Between the base 15 of the recess 2, on which the cylindrical operating members 12, 13 rest, and the plate 5, there is disposed a bolt 16 (see FIGS. 2 and 4) having the shape generally of a "T" with a vertical arm 17 and two opposed horizontal arms 18 and 19.

In a central region common to the horizontal arms 18, 19, the bolt has a bore 20 which is mounted on a pivot 21 fast with the base of the recess 2, and the axis ZZ' of which pivot is substantially parallel to the axes XX' and YY'.

The bolt is advantageously manufactured by molding from a plastics material appropriate to its function, and the bolt uses its vertical arm 17, the thickness of which is selected to impart to it a certain resilience, as a resilient return element arranged to ensure for the bolt a rest position which places the arms 18, 19 of the bolt parallel to a plane passing through the axes XX' and YY', and at equal distances from the collars 12, 13.

The end 22 of the resilient arm 17 is engaged between two pins 23, 24 fast to the base of the recess 2; the plate 5 and the base 15 of the recess serve as stops which limit axial movement of the bolt on its pivot. It will be noted in FIGS. 1 and 3 that each arm 18, 19 of the bolt is provided with a respective inclined surface 25, 26 terminated by respective edges 27, 28, and directed downwardly.

Figure 2:
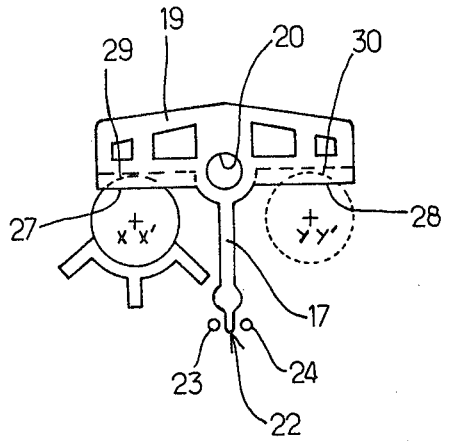
FIG. 2 is an elevation of part of the device, the switches being removed.

These surfaces 25, 26, inclined with respect to the axis ZZ', are disposed opposite to a respective peripheral region 29, 30, of the cylindrical operating member, seen in FIGS. 2 and 3, in such a manner that the displacement of a push button towards the right in FIG. 3 imparts to the bolt a certain angular displacement about its pivot axis ZZ' to bring it into a working position and cause the actuation of the corresponding switch.

Figure 4:
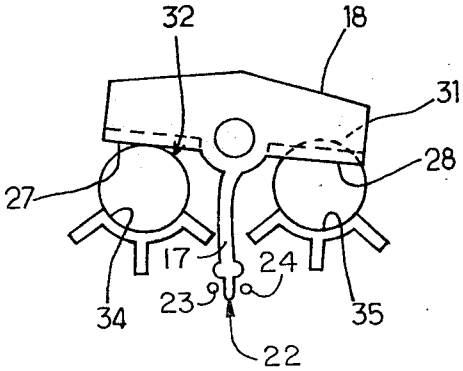
FIG. 4 is an elevation of the bolt in working position.

In this working position, shown schematically in FIG. 4, the tilting of the bolt brings a stop surface 31 of the arm 18, now moved downwardly, opposite to the cylindrical operating member of that push button which has not been actuated, and therefore prevents movement of said push button. If such a movement of said push button is nevertheless attempted, no reaction is communicated to the bolt because of the fact that the stop surface 31 is disposed in a plane perpendicular to pivoting axis ZZ'. As a result, the edge 27 of the other arm 19, which is to be found in this position of the bolt opposite to a cylindrical surface 32 of the cylindrical operating member, does not communicate thereto any force having a strength which would be capable of preventing return motion of the associated push button under the effect of its return spring 33.

In order to ensure easy sliding of the collar at the moment when it comes into contact with the inclined surface, a respective cylindrical guiding and supporting surface 34, 35, on a wall upstanding from the base of the recess, is disposed about a portion of each cylindrical operating member at the side opposite to the corresponding arms 18, 19 of the bolt.

We claim:

1. In a control device having: a box with a housing; first and second push buttons slidably mounted in the box and movable between first and second positions along two predetermined parallel directions of actuation, said first and second push buttons having first and second respective operating members; resilient means for normally resetting said push buttons into their first position; support means lodged in said housing; first and second electrical switches respectively mounted on said support means for cooperation with said first and second operating members; a locking device comprising pivot means fixedly mounted within said box between the said electrical switches and said operating members, said pivot means defining a pivoting axis parallel to the said directions of actuation; a T-shaped bolt arranged between said operating members and said switches, said T-shaped bolt having a first arm forming the head of the "T", a second arm perpendicular to the said first arm, said second arm being resiliently deformable, having a free end and forming the upright of the "T"; stop pins fixedly mounted within said box and between which the said free end is engaged, said first arm comprising first and second portions disposed on each side of said pivot means, each said portion comprising a stop surface perpendicular to the said directions of actuation and, on the edge of the said arm portion placed opposite to a respective operating member, a respective surface inclined with respect to said directions of actuation, said bolt being pivotably mounted about said pivot means on the center of the said first arm for pivoting said first arm between a first position wherein said first arm is parallel to the plane containing the said two directions of actuation and a second position, wherein the stop surface of one of the said portions of said first arm is disposed opposite to that one of said operating members which is thus prevented to move into its second position, whereas the other operating member is in its second position and cooperates with the respective inclined surface to pivot the said first arm into said second position.

2. A locking device, according to claim 1, wherein said housing has a base and said support means comprise lugs, a plate supported by said lugs, said bolt being arranged between the said base and the said plate, said base and said plate limiting axial movement of said bolt on the pivot means.

3. A locking device, according to claim 1, wherein the said housing has first and second guiding surfaces and the respective operating members each has a cylindrical surface which cooperates along one generatrix thereof with the said inclined surface and which is guided, along an opposite generatrix thereof, with the respective guiding surface.

4. A locking device according to claims 2 or 3, wherein said lugs, said pivot means, said stop pins and said guiding surfaces are all integrally formed on said housing.

* * * * *